United States Patent [19]

McNeely, Jr.

[11] Patent Number: 4,987,961

[45] Date of Patent: Jan. 29, 1991

[54] DRILL STEM ARRANGEMENT AND METHOD

[76] Inventor: Branch M. McNeely, Jr., 5313 Pine, Bellaire, Tex. 77401

[21] Appl. No.: 461,046

[22] Filed: Jan. 4, 1990

[51] Int. Cl.[5] ..... E21B 7/16

[52] U.S. Cl. ..... 175/320; 138/DIG. 11; 138/44; 138/109; 138/172; 138/177; 138/178

[58] Field of Search ..... 166/25, 38, 320; 138/DIG. 11, 44, 109, 172, 177, 178

[56] References Cited

U.S. PATENT DOCUMENTS

| | | | |
|---|---|---|---|
| 3,827,511 | 8/1974 | Jones | 175/25 |
| 4,051,906 | 10/1977 | Donegan | 175/320 X |
| 4,361,193 | 11/1982 | Gravely | 175/320 X |
| 4,435,972 | 3/1984 | Simon | 138/109 X |
| 4,760,889 | 8/1988 | Dudman | 175/320 |
| 4,771,811 | 9/1988 | DeCell et al. | 138/109 |

FOREIGN PATENT DOCUMENTS

| | | | |
|---|---|---|---|
| 2083856 | 3/1982 | United Kingdom | 175/320 |

OTHER PUBLICATIONS

"North Sea Experience with Aluminum Drill Pipe", Offshore Technology Conference, May 1989, B. A. Tarr and I. A. Graham (pp. 178, 180).

"Hevi-Wate Drill Pipe", Drilco Copyright 1980, Smith International, Inc.

*Primary Examiner*—William P. Neuder

*Attorney, Agent, or Firm*—Jack W. Hayden

[57] ABSTRACT

A member M provides a preferred combination of reduced weight with increased resistance to buckling under compressive loading and includes a tubular member 10 with tool joints TJ at each end for connection to form a drill stem. The tubular member 10 further includes a first portion or pipe section 15 adjacent either one of the tool TJ and may include a second portion or pipe section 15' adjacent the other tool joint TJ which are of smaller or reduced diameter than the adjacent tool joint. An enlarged portion 20 extends longitudinally of the tubular member from adjacent the first portion to adjacent the second portion where there is a second portion adjacent the other tool joint. If there is only one first portion adjacent one tool joint, the enlarged diameter extends from adjacent such first portion to the tool joint at the other end of the tubular member. The enlarged portion 20 has a larger inner and outer diameter than the adjacent first portion.

20 Claims, 3 Drawing Sheets

DRILL STEM ARRANGEMENT AND METHOD

STATEMENT OF THE PRIOR ART

Heretofore the drill string or drill stem used in drilling conventional well bores, such as oil and gas well bores, consisted of a drill string formed of tubular members, called drill pipe, connected in end to end relation to form a drill string or drill stem. Heavy tubular members called drill collars connected in end to end relation and located at a predetermined or desired location in the drill stem or drill string, generally adjacent and above the drill bit connected to the lower end of the drill string, are relied upon to achieve the penetration of the drill bit to drill the well bore in a manner well known in the art when the drill string is rotated.

The drill pipe and drill collars as well as the bit at the lower end thereof serve to transmit drilling fluid from the earth's surface through the drill stem or drill string to be discharged through the bit for cooling thereof and also to convey cuttings from the well bore through the annular space between the drill stem and the well bore to the earth's surface, as well as performing other functions well known to those skilled in the art. As conventionally used in the foregoing described operation, drill pipe in the drill stem is subjected to tensile and torsional loads but not compressive loads.

It has heretofore been common practice to displace the well bore laterally or to deviate the well bore in a desired manner. More recently, it has become more common to displace the well bore laterally great distances which is termed "Long Reach Drilling", as well as in some situations to drill laterally or horizontally to penetrate producing formations horizontally rather than vertically. The horizontal portion of the well bore may extend thousands of feet through one or more producing formations in an effort to increase production rate and maximum recovery from a formation, or a group of formations that may be penetrated by the horizontal well bore. This is termed "Horizontal Drilling ". The above described procedures are also being employed in some instances for recovery of minerals by drilling a well bore and recovering desired minerals in a manner well known to those skilled in that art.

The drill stem presently used in "Long Reach" and "Horizontal Drilling" has heretofore been fundamentally the same as used in prior vertical drilling operations which is not always desirable since some of the problems associated with very high angle drilling techniques are unique, or at least different from those encountered in drilling what is called vertical well bores.

For example, it may be difficult to provide sufficient weight to drill effectively in very high angle holes since the weight on the bit is a function of the inclination angle of the well bore being drilled. When the weight members, including the drill pipe and drill collars of a drill stem, are positioned at high inclination angles in a well bore, only a small portion of the available weight is transmitted to the bit at the bottom of the drill stem. It can be appreciated that when the well bore is to be drilled horizontally, relatively little, if any, of the weight is transmitted to the drill bit.

In an effort to attempt to overcome this problem in long reach or horizontal drilling, drill collars are, in some instances, placed higher up in the well bore where inclination angle is less. From this point to the bit, the drill stem or drill string is under compressive or "end" load and is subject to buckling and possible ultimate failure.

Also, friction between drill stem and well bore is a significant consideration particularly in very high angle or horizontal holes and is most pronounced where drill stem buckling is a problem. In some situations, heavy weight drill pipe weighing three times that of conventional drill pipe is used in an attempt to provide the desired resistance to buckling. Since friction may be considered as increasing directly with weight, friction is increased by a factor of three. Friction usually determines the limits for bottom hole displacement.

Another problem encountered in drilling deviated holes which may be accentuated in long reach or horizontal drilling, is that of proper hole cleaning. The drilling fluid circulated through the drill stem or drill string to the bottom of the well bore is then circulated back to the earth's surface in the well bore annulus surrounding the drill stem and serves at least several different functions among which is that of cooling the bit during the during the earth cutting operation and then removing the earth cutting from the well bore to the earth's surface, as presently noted. In deviated holes and even more so in long reach or horizontal drilling, the drill stem or drill string generally rests or lies eccentrically of the well bore generally along the low side of the well bore. Where ordinary or standard drill pipe is used solids carried by the drilling fluid in such circumstances tend to fall out of suspension from the drilling fluid and accumulate between the pipe and the well bore on the low side of the well bore and the drilling fluid may tend to channel along the high side of the well bore with little cleaning action and less tendency to remove the cuttings from the well bore.

SUMMARY OF THE INVENTION

One the objects of the present invention is to provide a tubular member, a plurality of which may be employed to form a drill stem, that provides a preferred combination of reduced weight with increased resistance to buckling under compressive loading.

Another object of the present invention is to provide a drill string tubular member, or component, which when joined together with other substantially identical tubular members, or components, constitutes a drill stem or drill string for carrying or sustaining compressive loads in any situation and particularly in a very high angle well bore. This assists in alleviating problems of drill stem buckling and drill stem friction.

As previously noted, it is also recognized that weight and friction may be considered as being directly related and increasing the weight increases the friction. When the friction exceeds the drill stem or rig capacity, the drilling operation is terminated.

Another object of the present invention is to provide adequate stiffness in the tubular members forming the drill stem and in the drill stem which results in adequate resistance to buckling while providing or maintaining a minimum weight in the drill stem.

Conventional standard weight drill pipe used in well bores heretofore drilled is much lighter in weight and results in less friction in comparison with drill collars or heavy weight drill pipe which are heavy weight tubular members. However, conventional standard drill pipe lacks both stiffness and weight that may be necessary in long reach and horizontal drilling and may be most susceptible to buckling and is of limited use in transmitting heavy compressive loads that may be required.

On the other hand, drill collars which are heavy and are intended to specifically supply bit weight and rigidity in well bore drilling heretofore encountered are least susceptible to buckling. However, the stiffness of drill collars, or possibly even heavy weight drill pipe, may be well above a useful level and their weight is so extreme as to result in prohibitive friction forces when employed at high angle in "Long Reach Drilling" or "Horizontal Drilling". For this reason, drill collar use, or heavy weight drill pipe use in high angle drilling is kept generally to a minimum. While heavy weight drill pipe buckling resistance and weight values are far less than drill collars, buckling resistance is still greater than that of conventional pipe but heavy weight pipe may weigh three times or more as much and thus produces three times the friction in high angle well bore drilling.

The configuration and structural arrangement of the present invention also assists in maintaining the cuttings in suspension in the drilling fluid for removal from the well bore as well as in cleaning the well bore.

The present invention overcomes some of the problems encountered in "Long Reach Drilling" or "Horizontal Drilling" by recognizing that a drill stem or drill string in a high angle hole is not a single beam but is a series of beams joined end to end.

Other objects and advantages of the present invention will become apparent from a consideration of the following description and drawings.

DESCRIPTION OF THE PREFERRED EMBODIMENTS

Figure 1:
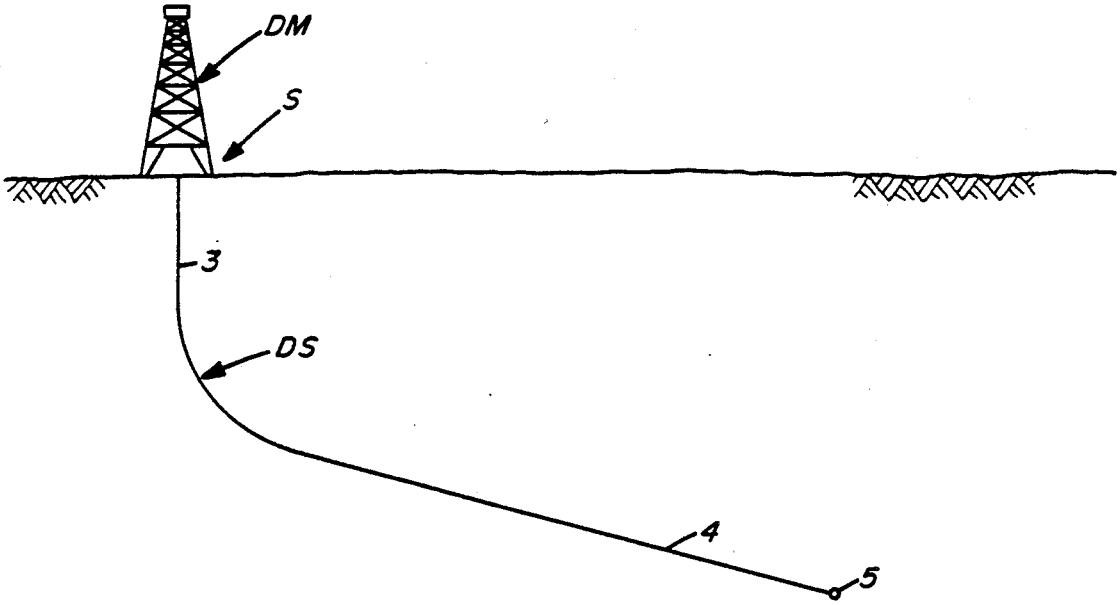
FIG. 1 is a schematic view illustrating a drilling mast or drilling rig and drill stem or drill pipe extending downwardly therefrom illustrating one relationship of the drill string in long reach drilling.
Figure 4:
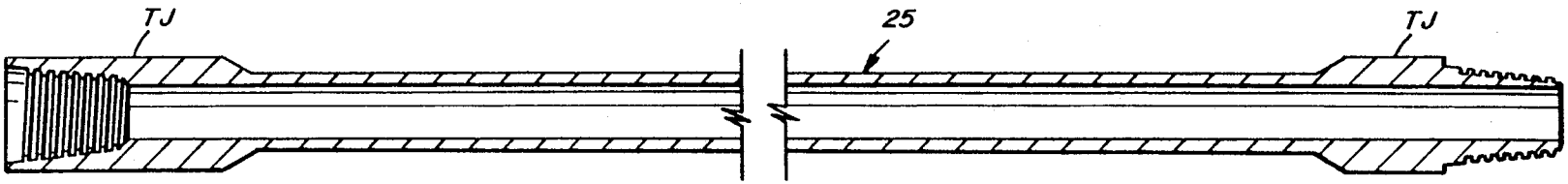
FIG. 4 (PRIOR ART)
FIG. 4 is a sectional view illustrating a conventional joint of drill pipe.

Attention is first directed to FIG. 1 of the drawings illustrating one relationship of the drill stem or drill string in long reach drilling. A drill mast is represented by the letters DM. The drilling mast DM is located adjacent the earth's surface or on a platform or other suitable support represented at S on land or water covered area. Extending from the drilling mast on the support S is a drill stem or drill string represented generally by the letters DS, which drill string is shown as extending into a well bore that has a relatively standard or which may be termed a vertical portion 3 and a deviated portion represented at 4 with a drill bit represented at 5 connected to the lower end thereof. The drill stem or drill string is formed of a plurality of tubular members of well known configuration as shown in FIG. 4 connected in end to end relationship by tool joints TJ, and a drill bit is secured at the lower end of the drill string.

Figure 2:
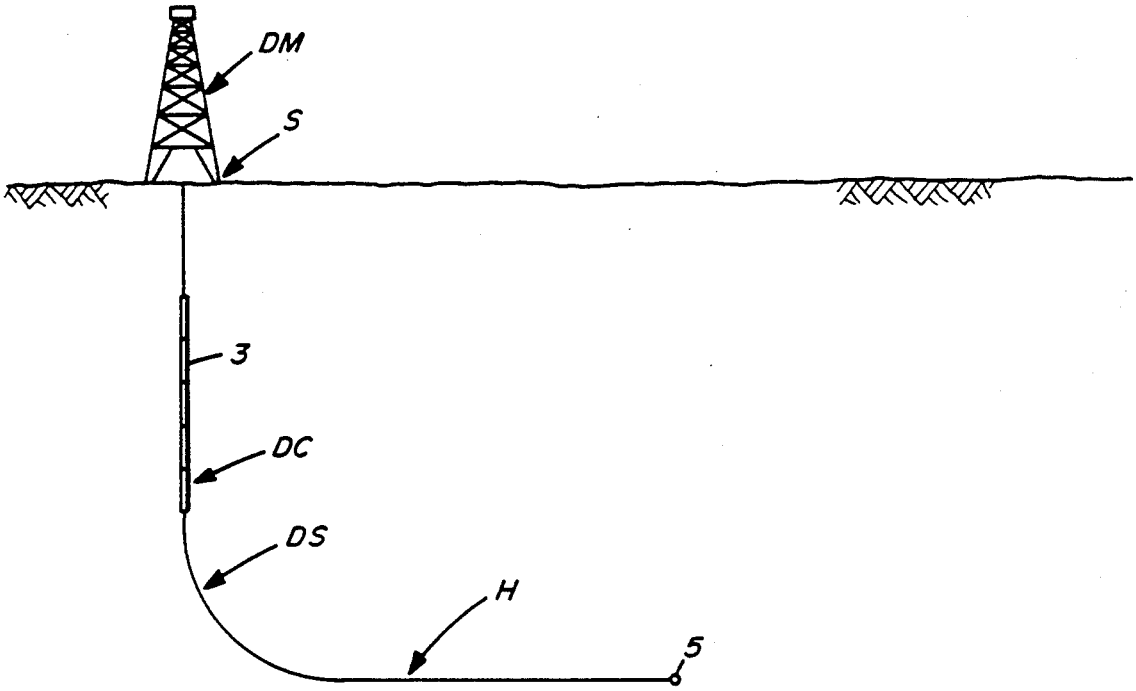
FIG. 2 is a schematic illustration of a drilling mast with the drill stem or drill string extending downwardly therefrom into the earth's surface and representing one relationship in horizontal drilling.

In FIG. 2 the drilling mast DM is again shown as is the support S. The drill string DS is again represented as extending from the working area of the drill mast DM, and a plurality of drill collars DC are shown as being in the vertical or standard portion 3 of the well bore with the horizontal portion of the well bore being represented generally by the letter H. A drill bit 5 is again shown as being secured at the lower end of the drill string.

The FIG. 1 form represents what is normally termed long reach drilling and FIG. 2 schematically represents what is normally termed horizontal drilling. In some instances the terminology for the two types of wells illustrated may vary.

Figure 3:
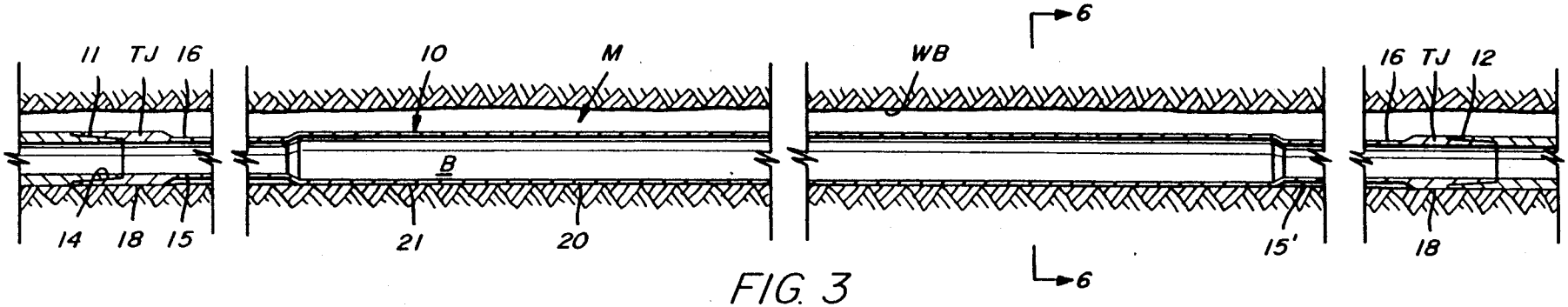
FIG. 3 is a sectional view illustrating the preferred arrangement of the present invention and illustrating it resting on the low side of a well bore in long reach or horizontal drilling.

Attention is now directed to FIG. 3 wherein one embodiment of a member formed in accordance with the present invention is shown and is represented generally by the letter M on the low side of a deviated well bore WB. The member M includes a tubular member 10 which tubular member has a bore B extending longitudinally therethrough as shown and includes tool joints represented by the letters TJ at each end which are joined to other components as will be described to form the tubular member 10. The joining may be accomplished in any suitable means such as by welding or the like.

A tool joint at one end of the tubular member 10 is provided with internal threads 11 in an enlarged bore 14 at the end of the tubular member to form what is termed a female threaded tool joint while the tool joint at the other end of the tubular member 10 is shown as being provided with external threads 12 to form a male threaded tool joint.

The tubular member 10 includes a first portion or first pipe section 15 which is connected to and extends from a tool joint at one end of the tubular member 10, and in FIG. 3 is shown as extending from adjacent the tool joint TJ at one end of the member which is provided with the female box 11 as previously described. It will be noted that the outer diameter represented at 16 of the first portion or first pipe section 15 of the tubular member 10 is smaller than the outer diameter of the adjacent tool joint TJ at the end of the tubular member and is also smaller then the tool joint TJ at the other end of the tubular member.

In this embodiment there is a second portion or pipe section referred to by the numeral 15' adjacent the other tool joint TJ at the other end of the tubular member which second portion may be of the same outer reduced diameter 16 as the first portion or pipe section 15 of the tubular member 10.

Figure 3A:
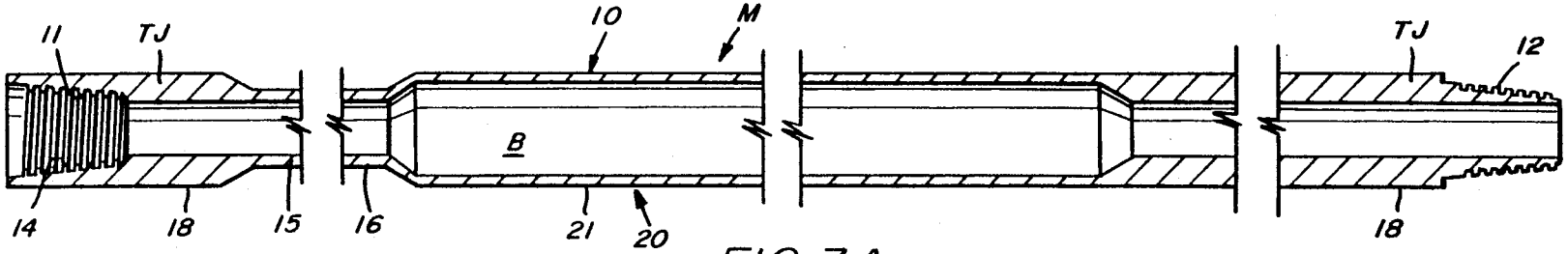
FIG. 3A illustrates an alternate embodiment of the invention shown in FIG. 3.

An enlarged portion or pipe section 20 extends longitudinally and continuously of the tubular member 10 between first and second pipe portions 15 and 15' as shown in FIG. 3A. The enlarged portion 20 is connected between the pipe sections 15 and 15' by any suitable manner such as welding. The enlarged section 20 has an outer diameter 21 larger than the outer diameter of the first or second portions 15, 15'. Preferably, the outer diameter, represented at 18 of the tool joints 11 or 12, but may vary within the range hereinafter indicated. The inner diameter of the bore in portion 20 is larger than the inner diameter of the bore in portions 15, 15' as shown.

FIG. 3A represents another embodiment of the member M, and like numerals represent like parts shown in FIG. 3. For example, it will be noted that tool joints TJ are provided at each end of a tubular member 10, with one of the tool joints on one end of the tubular member 10 having an enlarged bore in which are formed internal threads 11. A first pipe section 15 is connected adjacent the tool joint having threads 11 and extends longitudinally therefrom. In the FIG. 3A embodiment, the second portion 15' is eliminated, and the enlarged portion 20 of the FIG. 3 embodiment is connected to the tool joint at the other end of the tubular member as shown and extends longitudinally to the first portion or pipe section 15 at the one end of the tubular member. It can be appreciated that the reduced diameter portion 15 could be adjacent the tool joint TJ having threads 12 at the other end of the tubular member rather than on the one end of the tubular member 10 as illustrated in FIG. 3. The diameter and other physical relationships between the tool joint, the reduced portion 15 and the enlarged portion 20 are the same as those above described with regard to FIG. 3A. In other words, the enlarged continuous portion 20 of the FIG. 3A embodiment is larger in diameter than the first portion 15 and in the preferred embodiment is substantially the same diameter as the tool joints, but may vary as described above with regard to the FIG. 3 embodiment.

A conventional or standard joint of drill pipe is represented at 25 in FIG. 4 demonstrating what is generally employed and illustrating a tool joint TJ at each end with a single smaller portion or pipe section extending therebetween as illustrated.

Figure 5:
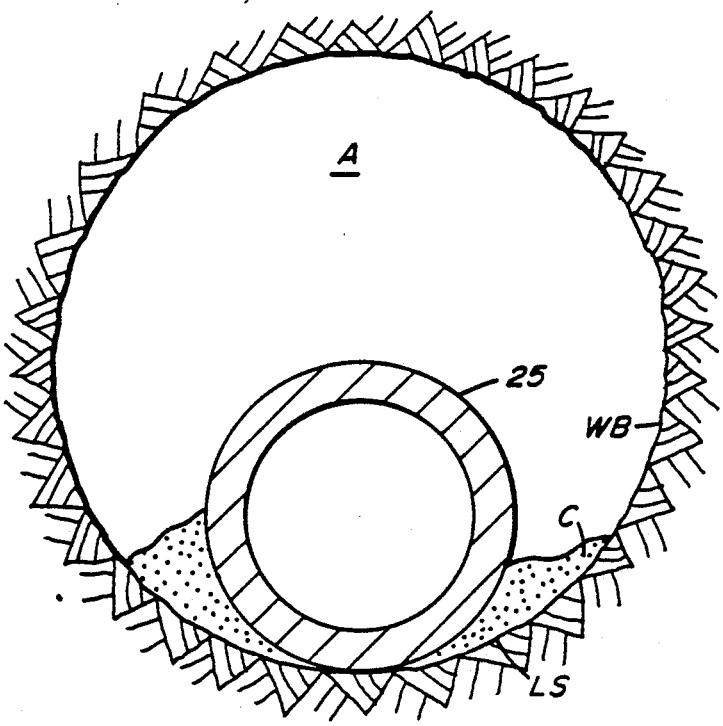
FIG. 5 (PRIOR ART)
FIG. 5 is a cross-sectional view illustrating the relationship of a conventional drill string or drill stem on the low side of a typical high angle well bore.

FIG. 5 represents a conventional drill stem on the low side LS in a typical high angle well bore WB and it will be noted that the tubular member 25 of the drill string or drill stem represents the portion extending between the tool joints. It will also be noted that there is substantial clearance or annular space A between the conventional drill string member 25 illustrated in FIG. 5 and the well bore represented at WB. It has been found, as previously mentioned that in a steeply inclined well bore where an ordinary drill string is employed, cuttings will tend to separate from the drilling fluid as it passes through annulus A and collects on the low side of the well bore, such cuttings being represented by the letter C. The annulus A above or adjacent the ordinary drill string is relatively large so that the velocity of the drilling fluid through the annulus is relatively slow thus enabling the cuttings to settle readily which may cause sticking or increase the friction and the tendency to buckle.

Figure 6:
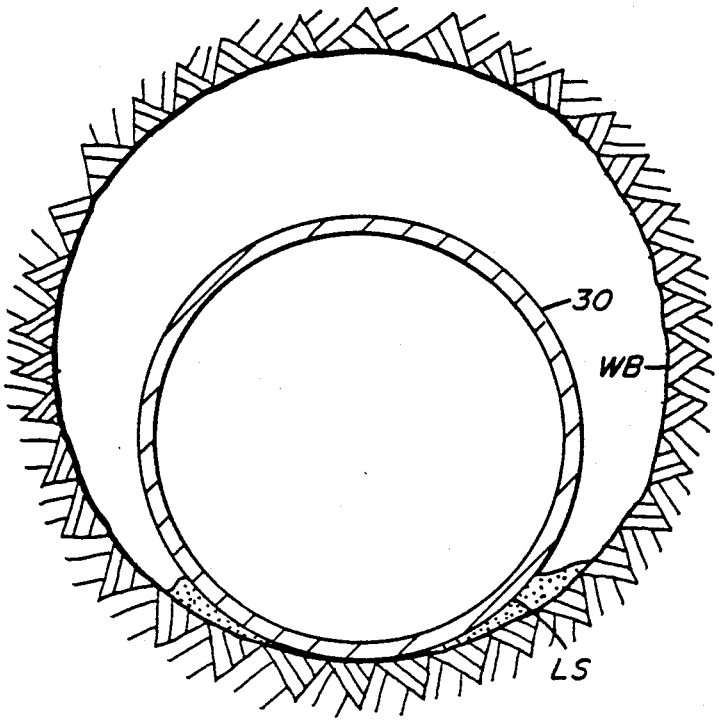
FIG. 6 is a cross-sectional view on the line 6-6 of FIG. 3 of a drill stem employing the present invention and showing the relationship of the well bore annulus to the enlarged, longitudinally extending portion or section of the tubular member of the present invention that forms the drill stem.

With reference to FIG. 6, the enlarged portion or pipe section of the member M of the present invention is shown at 20. The drill stem or drill string made up with members M of the present invention is represented as lying or resting on the low side LS of a highly inclined well bore represented by the letters WB with the low side of such well bore being represented by the letters LS. A drill string or drill stem in this position and carrying a compressive load may be considered as an "end loaded" beam or strut. When sufficient load is applied, the beam buckles. Resistance to buckling may be achieved through a combination of beam weight and stiffness. Specifically, for a given clearance between drill stem and well bore, the critical load at which buckling occurs is a function of the square root of the product of weight and stiffness.

Conventional standard weight drill pipe as used in drilling vertical holes is the lightest weight and thus results in the least friction. However, it lacks both stiffness and weight and is therefore most susceptible to buckling and is of limited practical use in transmitting heavy compressive loads to effect efficient drilling particularly in drilling highly deviated holes such as long reach and horizontal well bores.

As noted previously, drill collars and heavy wall drill pipe are constructed to supply bit weight and rigidity in vertical drilling and are least susceptible to buckling but generally the stiffness of drill collars is well above a useful level and their weight is so extreme as to result in prohibitive friction forces. Heavy wall drill pipe buckling resistance and weight load are substantially less than drill collars, and its buckling resistance may be twice that of conventional pipe but it may weigh three times as much or more and produces three times the friction in a high angle well bore.

In conventional drill pipe which is joined together by tool joints, the tool joints are the heaviest and most rigid portion of the beam and serve to hold the beam ends firmly against the side walls so as to in effect fix the beam ends. Since the pipe extending between the tool joints is of smaller diameter, is lighter and more flexible, end loading will begin to buckle the pipe between the tool joints.

The present invention overcomes this in that it provides a structure to increase the stiffness between the tool joints by providing portion 20 which increases the diameter to a maximum commensurate with good drilling practice for a given hole diameter. At the same time, the wall section of the enlarged section 20 is kept to a minimum to minimize the overall weight of such structure.

Referring again to FIGS. 3 and 3A, it is noted that the member M in both views illustrating embodiments of applicant's structure of a single tubular member used to form a drill stem when joined with other similar tubular members provides a portion of a pipe section or pipe joint adjacent at least one tool joint and such pipe section or portion is retained at conventional diameter depending upon the pipe weight and pipe size of the portion 15 to facilitate handling and permit stress distribution during rotation in a curved well bore. It can be appreciated that the greatest flexure in a tubular member in a drill stem in a highly deviated well bore will occur at the smaller diameter sections such as sections 15 and 15' adjacent the tool joints 11 and 12. This smaller diameter portion functions to release the stress on the threads in the joint, and thus the form shown in FIG. 3 is the preferred form.

It is not necessary to provide the reduced diameter adjacent both tool joints, although it does assist in relieving the stress in the threaded portions of the tool joints as noted above. If desired, a single reduced diameter portion may be employed as in 15 in FIG. 3A.

Referring further to FIGS. 3 and 3A, the present invention provides other advantages. The pressure required to circulate drilling fluid through the drill stem, supply power to downhole motor, provide velocity for bottom hole cleaning and return cuttings to the surface typically is several thousand pounds per square inch. Flowing pressure is maximum at the pump discharge at the earth's surface diminishing with losses as it passes through the drill stem and drill collars and then drops sharply through a downhole motor where it is employed. The pressure falls still more at the bit. Pressure at any point in the annular space between the drill stem and the well bore is always less than the pressure inside the drill stem at the same point.

The flowing pressure differential, that is the pressure inside the drill stem in relation to the pressure of the drilling fluid in the annulus in the well bore externally of the drill stem while drilling is maximum at the surface and diminishes to a minimum at the well bottom as above noted.

The pressure inside the drill stem acting on the inside area of the drill stem less the pressure in the annulus of the well bore outside the drill stem acting on the outside area of the drill stem imposes a tensile load on the drill stem. This load constitutes a pre-load in opposition to any compressive buckling load applied to the drill stem. In the present invention the inside area of the member M is increased or maximized throughout a substantial extent of the tubular member 10. This tensile pre-loading in applicant's structure is substantially increased over that acting on a conventional drill pipe heretofore used in high angle drilling such as long reach or horizontal drilling.

In horizontal drilling, the buckling force follows the same general pattern noted above with regard to the tensile pre-load. That is, the buckling force in horizontal drilling is considered as being at a maximum immediately below any weight members, such as drill collars, and then diminishes progressively from that point downwardly in the drill stem.

The structure of the present invention develops a tensile pre-load which resists buckling and varies directly with the demand for such resistance. For example, by regulating the drilling fluid pump output, the resistance to buckling is controllable. As pump pressure is raised or lowered the hydraulic buckling resistance is increased or decreased. Most significantly, when the pump is shut off or disconnected, there is no differential or stiffening—that is no tensile pre-load; however, this latter is a benefit when drill stem is being run into or removed from the well bore since it is desired to have the pipe flexible when going around a curve and it is preferred that during such time that no tensile load be present.

Thus, the present invention enables the drill stem formed by tubular members of the present invention to pass through sharp bends and irregularities in its most flexible condition. Subsequently, it may be used in its most rigid condition when drilling with compressive load by regulating the pump pressure as may be desired to apply the desired tensile pre-loading to the pipe to resist the buckling tendencies.

Attention is again directed to FIGS. 5 and 6 of the present invention which demonstrate another significant benefit afforded by the structure and method of the present invention. Drilled cuttings are removed from the well bore by fluid circulation and effective removal may be largely dependent on fluid velocity in the well bore annulus surrounding the exterior of the drill stem. In the present invention, the tubular members comprising the drill stem structure are designed to have the largest outside diameter consistent with conventional retrieval methods. To achieve minimum weight, the inside diameter is also large. When compared with conventional drill pipe both diameters inside and outside at the enlarged central section of the drill stem tubular member, or component, are much larger.

Benefits of the foregoing are at least two fold. Increased internal flow way reduces pressure losses inside the drill stem and allows greater fluid volume for a given pump capacity. At the same time the enlarged outside diameter reduces the annular opening on the outside of the larger diameter section extending between the tool joints to a substantial extent. The combination of increased fluid volume and decreased flow area in the annulus results in an increase in the velocity of the circulating fluid to inhibit separation of suspended solids in the annular space A thus improving well bore cleaning in a horizontal well.

The parameters within which the present invention is operative are defined by one or more of the following. The first portion or pipe section 15 adjacent one tool joint, or adjacent both tool joints as described, respectively has an outer diameter that is smaller than the outer diameter of said tool joints. The enlarged portion, or pipe section 20 on the tubular member extending between the pipe section and the tool joint in FIG. 3A and extending between first pipe section and second pipe section in FIG. 3 has an outer diameter represented at 21 larger than the outer diameter of the first portion 15 when employed in the FIG. 3A embodiment or a larger diameter than the diameter of both the first portion or first pipe section 15 and second portion 15' when employed in the FIG. 3 embodiment.

Further, the weight of the enlarged portion or pipe section 20 is not more than approximately 50% heavier per linear foot than a drill pipe section having substantially the same length as the tubular member 10 and which drill pipe section is approximately the same outer diameter and wall thickness as the portion or pipe section 15 or 15'.

As a practical matter, the outer diameter 21 of the enlarged portion 20 is in the range of approximately 10% to approximately 100% larger than the outer diameter of the portions 15 or 15'. Also, the wall thickness of the enlarged portion 20 is not more than approximately 50% greater than the wall thickness of the first portion or pipe sections 15, 15'.

The length of the enlarged portion 20 is in the range of approximately 30% to approximately 90% of the overall length of the tubular member 10.

The inner diameter of the enlarged portion 20 is in the range of approximately 10% to approximately 100% larger then the inner diameter of the portion 15 or 15' on the tubular member 10. In the preferred form, the outer diameter of the enlarged portion 20 is substantially the same as the outer diameter of the tool joints 11 and 12.

The enlarged portion 20 is preferably uniform, but in some circumstances, if necessary, may be configured to relieve any tendency toward wall sticking.

The tubular member forming the member M is normally approximately thirty feet in length, but may be longer or shorter as desired. The longitudinal extents of the first, second, third portions and each tool joint of one preferred embodiment are four feet, twenty feet, four feet and one foot each in a thirty foot length of tubular member 10, but this may vary within the ranges heretofore described.

The foregoing provides a structure that enables a tubular member to be used as a drill stem component in drilling very high angle well bores and provides an enlarged light wall central section preferably about the same outside diameter as the tool joints and comprising at least approximately 30% to approximately 90% of the overall length of the tubular member.

The arrangement of the present invention also enables it to be used in a drill stem or drill string for drilling a very high angle well bore and withstands approximately 50% more compressive load than a drill string member having the same weight and diameter as the section 15 throughout the longitudinal extent between the tool joints of the tubular member.

In addition, the foregoing enables a tensile pre-load to be generated and controlled in the drill stem serving to resist any buckling compressive loading applied thereto during drilling operations which may be desirable in normal well drilling as well as in deviated well bore drilling. The restriction of the annulus by the enlarged portion 20 serves to decrease the volume of the well bore annulus and enable the velocity of the drilling fluid to increase tending to inhibit separation of bit cuttings from the drilling fluid as it passes therethrough.

By maintaining the relationship of the weight of the enlarged portion 20 per linear foot to a drill pipe section that is substantially the same length as said tubular member 10 and which drill pipe section is substantially the same outer diameter and wall thickness as the first portion or pipe section 15 and the outer diameter of said third portion or enlarged portion 20 in the range of approximately 10% to approximately 100% larger than the outer diameter of said first portion or pipe section 15, the beneficial effects of tensile pre-loading in the presence of a hydraulic differential between the drill stem and the annulus is provided as well as enhancing the resistance to buckling of the drill stem under compressive loading.

By maintaining the outer diameter of the enlarged portion 20 in the range of approximately 10% to approximately 100% larger than the outer diameter of the first portion or pipe section 15 and the length of the portion 20 in the range of approximately 30% to approximately 90% of the overall length of the tubular member 10, the beneficial effects of controlling the velocity of the drilling fluid flow in the annulus A as well as the beneficial hole cleaning effects in the annulus A are provided.

The tubular members of the present invention may be formed by joining tool joints and pipe sections together or by forming in any other suitable manner well known to those skilled in the art.

The foregoing disclosure and description of the invention are illustrative and explanatory thereof, and various changes in size, shape and materials as well as in the details of the illustrated construction may be made without departing from the spirit of the invention.

What is claimed is:

1. A member for use in a drill string for forming a bore in the earth comprising:

a tubular member having a bore therethrough and including:

tool joints at each end of said tubular member for securing said tubular member in the drill string;

a first portion extending longitudinally of said tubular member from adjacent one of said tool joints, said first portion having an outer diameter smaller than the outer diameter of said tool joints; and an enlarged portion extending longitudinally of said tubular member from adjacent said first portion to the other of said tool joints, said enlarged portion having outer and inner diameters larger than the outer and inner diameters, respectively of said first portion.

2. The member of claim 1 wherein the weight of said enlarged portion is not more than approximately 50% heavier per linear foot than a drill pipe section having substantially the same outer diameter and wall thickness as said first portion.

3. The member of claim 1 wherein the outer diameter of said enlarged portion is in the range of approximately 10% to approximately 100% larger than the outer diameter of said first portion.

4. The member of claim 1 wherein the length of said enlarged portion is in the range of approximately 30% to approximately 90% of the over all length of said tubular member.

5. The member of claim 1 wherein the inner diameter of said enlarged portion of said tubular member is in the range of approximately 10% to 100% larger than the inner diameter of said first portion.

6. A member for use in a drill string for forming a bore in the earth comprising:

a tubular member having a bore therethrough including:

a first tool joint at one end of said tubular member;

a second tool joint at the other end of said tubular member;

a first portion extending longitudinally of said tubular member from adjacent said first tool joint, said first portion having an outer diameter smaller than the outer diameter said first tool joint;

a second portion extending longitudinally of said tubular member from adjacent said second tool joint, said second portion having an outer diameter smaller than the outer diameter said second tool joint; and an enlarged portion extending longitudinally of said tubular member between said first and second portions, said enlarged portion having outer and inner diameters larger than the outer and inner diameters, respectively, of either said first or second portions.

7. The member of claim 8 wherein the weight of said enlarged portion is not more than approximately 50% heavier per linear foot than a drill pipe section having substantially the same outer diameter and wall thickness as said first portion.

8. The member of claim 6 wherein the outer diameter of said enlarged portion is in the range of approximately 10% to approximately 100% larger than the diameter of either said first or said second portion.

9. The member of claim 6 wherein the length of said enlarged portion is in the range of approximately 30% to approximately 90% of the over all length of said tubular member.

10. The member of claim 6 wherein the inner diameter of said enlarged portion of said tubular member is in the range of approximately 10% to 100% larger than the inner diameter of either said first or second portion.

11. A member for use in a drill string for forming a bore in the earth comprising:

a tubular member having a bore therethrough and including:

tool joints at each end of said tubular member for securing said tubular member in the drill string;

a first portion extending longitudinally of said tubular member from adjacent one of said tool joints, said first portion having an outer diameter smaller than the outer diameter of said tool joints;

an enlarged portion extending longitudinally of said tubular member from adjacent said first portion to the other of said tool joints, said enlarged portion having:

outer and inner diameters larger than the outer and inner diameters, respectively, of said first portion and which outer diameter is in the range of 10% to 100% larger than the outer diameter of said first portion; weight which is not more than 50% heavier per linear foot than a drill pipe section having substantially the same outer diameter and wall thickness as the outer diameter and wall thickness of said first portion; and a length in the range of approximately 30% to approximately 90% of the overall length of said tubular member.

12. A member for use in a drill string for forming a bore in the earth comprising:

a tubular member having a bore therethrough and including:

a first tool joint at one end of said tubular member; a second tool joint at the other end of said tubular member; a first portion extending longitudinally of said tubular member from adjacent said first tool joint, said first portion having an outer diameter smaller than the outer diameter of said first tool joint;

a second portion extending longitudinally of said tubular member from adjacent said second tool joint, said second portion having an outer diameter smaller than said second tool joint; an enlarged portion extending longitudinally of said tubular member between said first and second portions, said enlarged portion having:

outer and inner diameters larger than the outer and inner diameters, respectively of said first portion and which outer and inner diameters, respectively, are in the range of 10% to 100% larger than the outer diameter of either said first or second portion of said tubular member; weight which is not more than 50% heavier per linear foot than a drill pipe section having substantially the same outer diameter and wall thickness as the outer diameter and wall thickness of either said first or second portion on said tubular member; and the length of said enlarged portion being in the range of approximately 30% to approximately 90% of the overall length of said tubular member.

13. A drill stem for drilling a high angle well bore wherein drilling fluid is circulated through the drill stem and discharged at the lower end thereof and then recirculated in the clearance between the drill stem and the well bore to the earth's surface, such structure including:

a plurality of tubular members each of which has a bore extending longitudinally therethrough and including:

tool joints at each end of each of said tubular members for securing said tubular members in end to end relation to form the drill stem;

a first portion extending longitudinally of each of said tubular members from adjacent one of said tool joints, said first portion having an outer diameter smaller than the outer diameter of said adjacent tool joints;

an enlarged portion extending longitudinally of each of said tubular members from adjacent said first portion to the other of said tool joint; and said enlarged portion having outer and inner diameters which are in the range of approximately 10% to approximately 100% larger than the outer and inner diameters, respectively, of said first portion to form an enlarged bore within said enlarged portion that produces an increased tensile preload in the drill stem in response to the pressure differential between the fluid pressure in the enlarged bore of said enlarged portion of each of said tubular members and the fluid pressure externally of the drill stem in the well bore.

14. A drill stem for drilling a high angle well bore wherein drilling fluid is circulated through the drill stem and discharged at the lower end thereof and then recirculated in the clearance between the drill stem and the well bore to the earth's surface, such structure including:

a plurality of tubular members having a bore therethrough and including:

a first tool joint at one end of each said tubular members;

a second tool joint at the other end of each of said tubular members;

a first portion extending longitudinally of each of said tubular members from adjacent, said first tool joint, said first portion having an outer diameter smaller than the outer diameter of said first tool joint;

a second portion extending longitudinally of each of said tubular members from adjacent, said second tool joint, said second portion having an outer diameter smaller than the outer diameter of said second tool joint;

an enlarged portion extending longitudinally of each of said tubular members between said first and second portions, said enlarged portion having outer and inner diameters, which are in the range of approximately 10% to approximately 100% larger than the outer and inner diameters, respectively, of said first portion to form an enlarged bore within said enlarged portion that generates an increased tensile preload in the drill stem in response to the pressure differential between the drilling fluid pressure in the enlarged bore of said enlarged portion of each of said tubular members and the drilling fluid pressure externally of the drill stem in the well bore.

15. A structure for use as a drill stem in drilling high angle well bores including:

a plurality of tubular members each of which has a bore extending longitudinally therethrough and including:

tool joints at each end of each of said tubular members for securing said tubular members in end to end relation to form the drill stem;

a first portion extending longitudinally of each of said tubular members from adjacent one of said tool joints, said first portion having an outer diameter smaller than the outer diameter of said adjacent tool joint;

an enlarged portion extending longitudinally of said tubular member from adjacent said first portion to the other of said tool joints said enlarged portion having outer and inner diameters larger than the outer and inner diameters, of said first portion; and said enlarged portion having weight which is not more than approximately 50% heavier per linear foot than a drill pipe section having substantially the same outer diameter and wall thickness as the outer diameter and wall thickness of said first portion and an outer diameter which is in the range of approximately 10% to approximately 100% larger than the outer diameter of said first portion to enhance the resistance to buckling of the drill stem while under compressive loading to drill high angle well bores.

16. A drill stem for drilling a high angle well bore wherein drilling fluid is circulated through the drill stem and discharged at the lower end thereof and then recirculated in the clearance between the drill stem and the well bore to the earth's surface, such structure including:

a plurality of tubular members each having a bore therethrough and including:

a first tool joint at one end of each said tubular members;

a second tool joint at the other end of each of said tubular members;

a first portion extending longitudinally of each of said tubular members from adjacent, said first tool joint, said first portion having an outer diameter smaller than the outer diameter of said first tool joint;

a second portion extending longitudinally of each of said tubular members from adjacent, said second tool joint, said second portion having an outer diameter smaller than the outer diameter of said second tool joint;

an enlarged portion extending longitudinally of each of said tubular members between said first and second portions, said enlarged portion having outer and inner diameters larger than the outer and inner diameters, respectively, of either said first or second portions; and said enlarged portion having weight which is not more than approximately 50% heavier per linear foot than a drill pipe section having substantially the same outer diameter and wall thickness as the outer diameter and wall thickness of said first portion and an outer diameter which is in the range of approximately 10% to approximately 100% larger than the outer diameter of said first portion to enhance the resistance to buckling of the drill stem while under compressive loading to drill high angle well bores.

17. A drill stem for drilling a high angle well bore wherein drilling fluid is circulated through the drill stem and discharged at the lower end thereof and then recirculated in the clearance between the drill stem and the well bore to the earth's surface, such structure including:

a plurality of tubular members each having a bore therethrough and including:

tool joints at each end of each of said tubular members for securing said tubular members in end to end relation to form the drill stem;

a first portion extending longitudinally of each of said tubular members from adjacent one of said tool joints, said first portion having an outer diameter smaller than the outer diameter of said adjacent tool joint;

an enlarged portion extending longitudinally of said tubular member from adjacent said first portion to the other of said tool joints said enlarged portion having outer and inner diameters larger than the outer and inner diameters, of said first portion; and said enlarged portion having a length in the range of approximately 30% to approximately 90% of the overall length of said tubular member and an outer diameter which is in the range of approximately 10% to approximately 100% larger than the outer diameter of said first portion to reduce the clearance between the drill stem and the well bore being drilled for increasing the velocity of the drilling fluid employed in cleaning the well bore.

18. A drill stem for drilling a high angle well bore wherein drilling fluid is circulated through the drill stem and discharged at the lower end thereof and then recirculated in the clearance between the drill stem and the well bore to the earth's surface, such structure including:

a plurality of tubular members having a bore therethrough and including:

a first tool joint at one end of each said tubular members;

a second tool joint at the other end of each of said tubular members;

a first portion extending longitudinally of each of said tubular members from adjacent said first tool joint, said first portion having an outer diameter smaller than the outer diameter of said first tool joint;

a second portion extending longitudinally of each of said tubular members from adjacent said second tool joint, said second portion having an outer diameter smaller than the outer diameter of said second tool joint;

an enlarged portion extending longitudinally of each of said tubular members between said first and second portions, said enlarged portion having outer and inner diameters, larger than the outer and inner diameters, respectively, of either said first or second portions; and said enlarged portion having a length in the range of approximately 30% to approximately 90% of the overall length of said tubular member and an outer diameter in the range of approximately 10% to approximately 100% larger than the outer diameter of said first portion to reduce the clearance between the drill stem and the well bore being drilled for increasing the velocity of the drilling fluid employed in cleaning the well bore.

19. A method of drilling a well bore comprising the steps of:

inserting in the earth a drill stem formed of a plurality of tubular members having tool joints at each end to join the tubular members together, the tubular members also including a reduced diameter portion adjacent one of the tool joints and an enlarged portion extending longitudinally of the tubular member from adjacent the reduced diameter portion to the tool joint at the other end of the tubular member, which enlarged portion is in the range of approximately 30% to approximately 90% of the length of the tubular member with the inner diameter of the enlarged portion being in the range of approximately 10% to approximately 100% larger than the inner diameter of the reduced portion; and pumping drilling fluid to circulate through the tubular members in the drill stem and back to the earth's surface between the well bore and drill stem.

20. A method of drilling a well bore comprising the steps of:

inserting in the earth a drill stem formed of a plurality of tubular members having tool joints at each end to join the tubular members together, the tubular members also including a reduced diameter portion extending longitudinally from each of the tool joints with an enlarged diameter portion extending longitudinally of the tubular member between the reduced diameter portions that is in the range of approximately 30% to approximately 90% of the length of the tubular member with the inner diameter of the enlarged portion being in the range of approximately 10% to approximately 100% larger than the inner diameter of the reduced diameter portions of the tubular member; and pumping drilling fluid to circulate through the drill stem and back to the earth's surface between the well bore and drill stem.

* * * * *